US006711754B2

(12) United States Patent
Chou

(10) Patent No.: US 6,711,754 B2
(45) Date of Patent: Mar. 30, 2004

(54) SWIMMING/DIVING GOGGLES

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 89 days.

(21) Appl. No.: 10/038,453

(22) Filed: Jan. 7, 2002

(65) Prior Publication Data

US 2003/0126674 A1 Jul. 10, 2003

(51) Int. Cl.[7] ..... A61F 9/02
(52) U.S. Cl. ..... 2/428
(58) Field of Search ..... 2/428, 430, 439, 2/440, 441, 426, 445, 443, 442, 446, 452; 351/43, 58

(56) References Cited

U.S. PATENT DOCUMENTS 4,087,865 A * 5/1978 Garofalo ..... 2/428
5,603,125 A * 2/1997 Chou ..... 2/428
5,650,866 A * 7/1997 Haslbeck ..... 351/43
5,771,499 A * 6/1998 Monaco et al. ..... 2/428
5,802,620 A * 9/1998 Chiang ..... 2/428
5,802,621 A * 9/1998 Chou ..... 2/430
5,896,589 A * 4/1999 Chou ..... 2/428
6,032,298 A * 3/2000 Chiang ..... 2/428
6,052,834 A * 4/2000 Chou ..... 2/428
6,151,720 A * 11/2000 Chiang ..... 2/428
6,253,387 B1 * 7/2001 Yu ..... 2/428
6,473,909 B1 * 11/2002 Chou ..... 2/428
6,499,148 B2 * 12/2002 Chou ..... 2/428

* cited by examiner

*Primary Examiner*—Gary L. Welch
(74) *Attorney, Agent, or Firm*—Charles E. Baxley

(57) ABSTRACT

A pair of swimming/diving goggles comprises two lenses, a protective frame, and a main frame. Each lens is made of rigid transparent material and includes a peripheral edge. The protective frame is made of a material that is slightly flexible and pull-resistant. The protective frame includes two rings each having a receiving groove for engaging with the peripheral edge of an associated one of the lenses. The main frame is made of soft material and securely engaged with the protective frame by means of molding injection. The main frame includes two padding portions for intimate contact with a user's eye sockets. The protective frame prevents disengagement of the lenses from the protective frame and the main frame when a pulling force is applied for wearing the pair of swimming/diving goggles.

10 Claims, 11 Drawing Sheets

SWIMMING/DIVING GOGGLES

BACKGROUND OF THE INVENTION

1. Field of the Invention

The present invention relates to a pair of swimming/diving goggles with improved assembling reliability, waterproof effect, and safety. In addition, the pair of swimming/diving goggles has improved strength and diversified ornamentation.

2. Description of the Related Art

FIG. 9 of the drawings illustrates a pair of conventional swimming goggles comprised of two lenses 1', two padding members 2', a bridge 3', and a head strap 4'. Each lens 1' is made of rigid transparent material and includes a flange 11' for engaging with an associated one of the padding members 2'. Each lens 1' further includes an inner connecting portion 12' for engaging with the bridge 3' and an outer connecting portion 13' for engaging with an associated end of the head strap 4'. Each padding member 2' is made of soft material and includes a deformable receiving groove 21' for receiving an associated lens 1'. Each padding member 2' further includes a padding portion 22' for intimate contact with a user's eye socket. The bridge 3' is made of slightly flexible material and is more rigid than the padding members 2'. Thus, the bridge 3' may deform in response to different contours of the user's face, allowing the padding members 2' to be in intimate contact with the user's eye sockets. However, the assembly of the simple engagement between the lenses 1' and the padding members 2' of the pair of swimming goggles is not reliable. In use, leakage tends to occur in the area of the padding members 2' when the pair of swimming goggles is impinged. In some cases, the padding members 2' could be disengaged from the lenses 1', and the user's eye sockets could feel pain or even be injured by the rigid lenses 1'.

FIGS. 10 and 11 illustrate another pair of conventional swimming goggles comprised of two lenses 5', two frames 6', a bridge 7', and a head strap 8'. Each lens 5' is made of rigid transparent material and includes a peripheral edge 51' for engaging with an associated frame 6'. The frames 6' and the bridge 7' are made of identical soft material. The lenses 5' are placed in a mold, and the soft material is injected into the mold and thus formed with the lenses 5'. Each frame 6' includes a padding portion 61' for intimate contact with a user's eye socket and a connecting portion 62' for engaging with an end of the head strap 8'. Each frame 6' includes an annular receiving groove 63' for receiving the peripheral edge 51' of the associated lens 5'.

As illustrated in FIG. 12, when a relatively large force is applied to the head strap 8' during wearing of the pair of swimming goggles, the connecting portion 62' of the respective frame 6' could expand and thus disengage from the respective lens 5'. As a result, the user's eye socket could be injured by the sharp edge of the lens 5'. In order to provide a comfort, intimate contact with the user's eye socket, each padding portion 61' of the respective frame 6' must be made by softer material. The bridge 7' and the frames 6' are highly deformable when they are integrally formed by the same material as the padding portions 61'. As a result, the frames 6' are apt to deform when applying a force to the head strap 8' for wearing purpose. In addition, the bridge 7' will deform to a large extent and thus press the nose of the user. Thus, the user will feel pain in the nose area. The above problems can be solved by means of making the frames 6' and the nose 7' with less soft material. But this results in discomfort to the user's eye sockets, as the padding portions 61' must be formed with the same material as the frames 6' and the nose 7'.

SUMMARY OF THE INVENTION

A pair of swimming/diving goggles in accordance with the present invention comprises two lenses, a protective frame, and a main frame. Each lens is made of rigid transparent material and includes a peripheral edge. The protective frame is made of a material that is slightly flexible and pull-resistant. The protective frame includes two rings each having a receiving groove for engaging with the peripheral edge of an associated one of the lenses. The main frame is made of soft material and securely engaged with the protective frame by means of molding injection. The main frame includes two padding portions for intimate contact with a user's eye sockets. The protective frame prevents disengagement of the lenses from the protective frame and the main frame when a pulling force is applied for wearing the pair of swimming/diving goggles.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
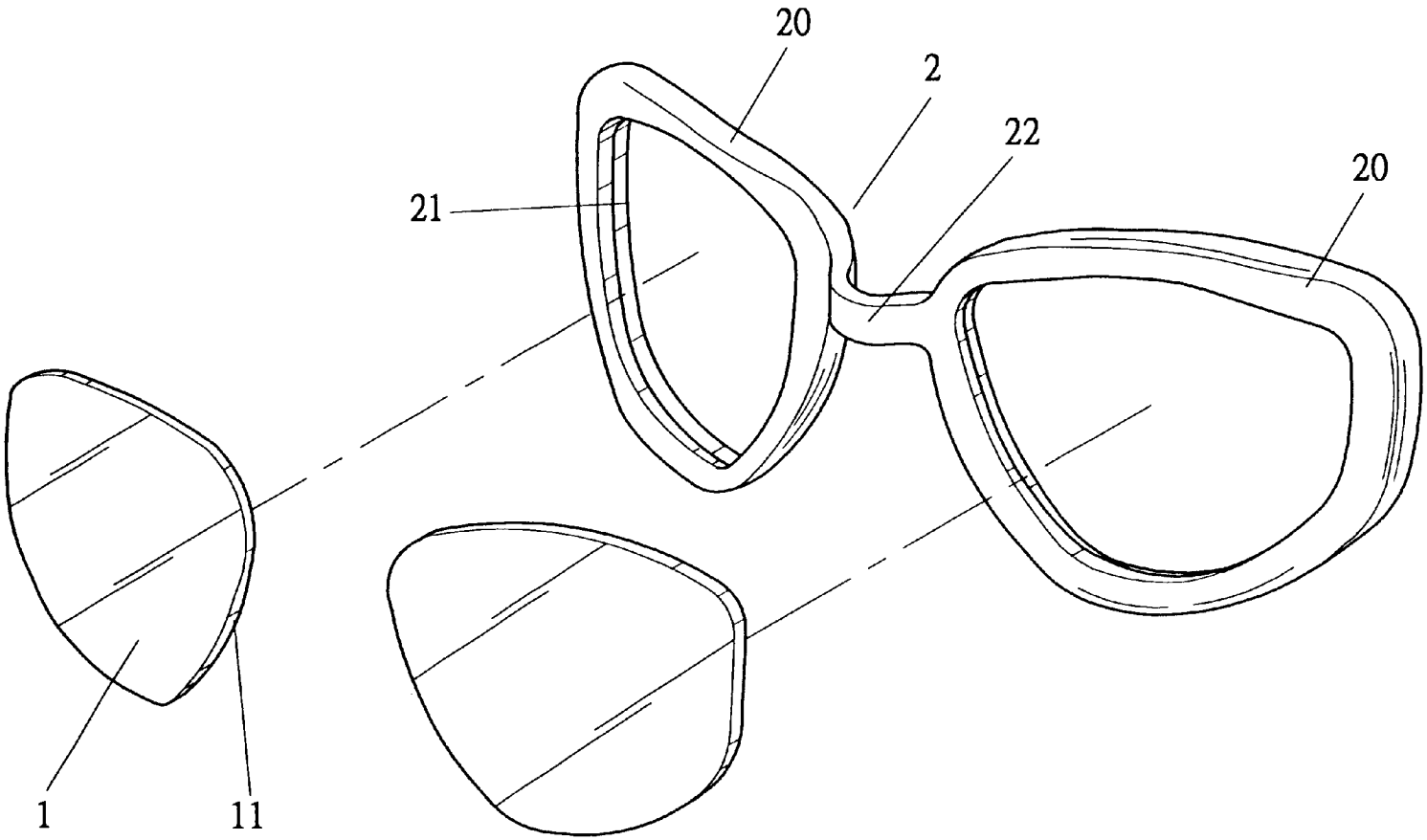
FIG. 1 is an exploded perspective view of two lenses and a protective frame of a pair of swimming/diving goggles in accordance with the present invention.
Figure 2:
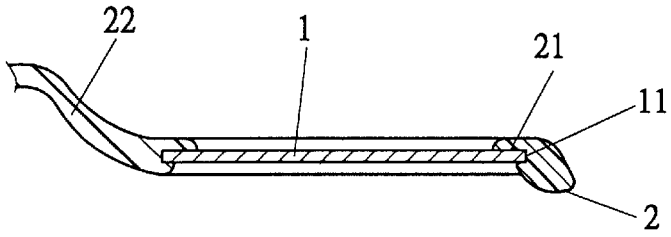
FIG. 2 is a sectional view of a portion of the lenses and the protective frame of the pair of swimming/diving goggles in FIG. 1
Figure 3:
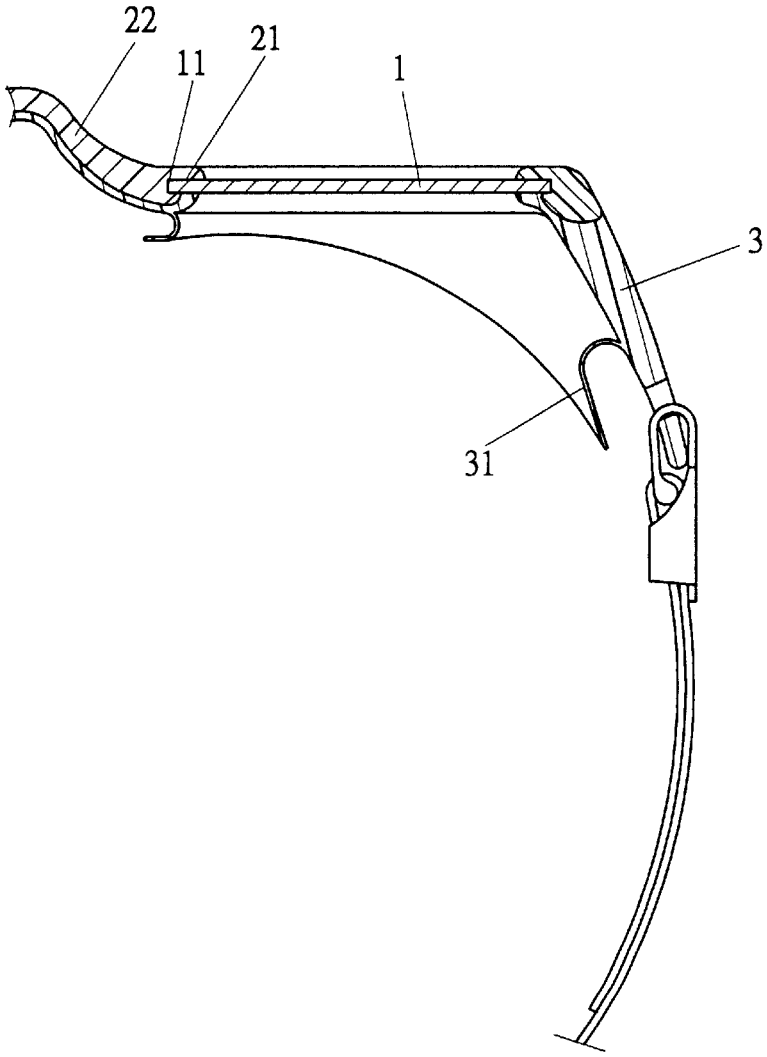
FIG. 3 is a top view, partly sectioned, of a portion of the pair of swimming/diving goggles in accordance with the present invention.

Referring to FIGS. 1 through 3, a pair of swimming/diving goggles in accordance with the present invention generally comprises two lenses 1, a protective frame 2, and a main frame 3. Each lens 1 is made of rigid transparent material and includes a peripheral edge 11 for engaging with the protective frame 2.

The protective frame 2 is made of a material that is slightly flexible and pull-resistant. The protective frame 2 includes two rings 20 each having a receiving groove 21 in an inner periphery thereof for engaging with the peripheral edge 11 of the respective lens 1 by means of using the flexibility of the rings 20. The protecting frame 2 further includes a bridge 22 for connecting the rings 20.

The main frame 3 is made of soft material and securely engaged with the protective frame 2 by molding injection. In manufacture, the protective frame 2 is placed in a mold (not shown) so as to be integrally connected to the main frame 3 after hardening of liquid material for the main frame 3 in the mold. Thus, a front portion of the main frame 3 is securely engaged with the protective frame 2 after formation. In addition, the main frame 3 includes two padding portions 31 in a rear end thereof for intimate contact with the user's eye sockets.

Figure 4:
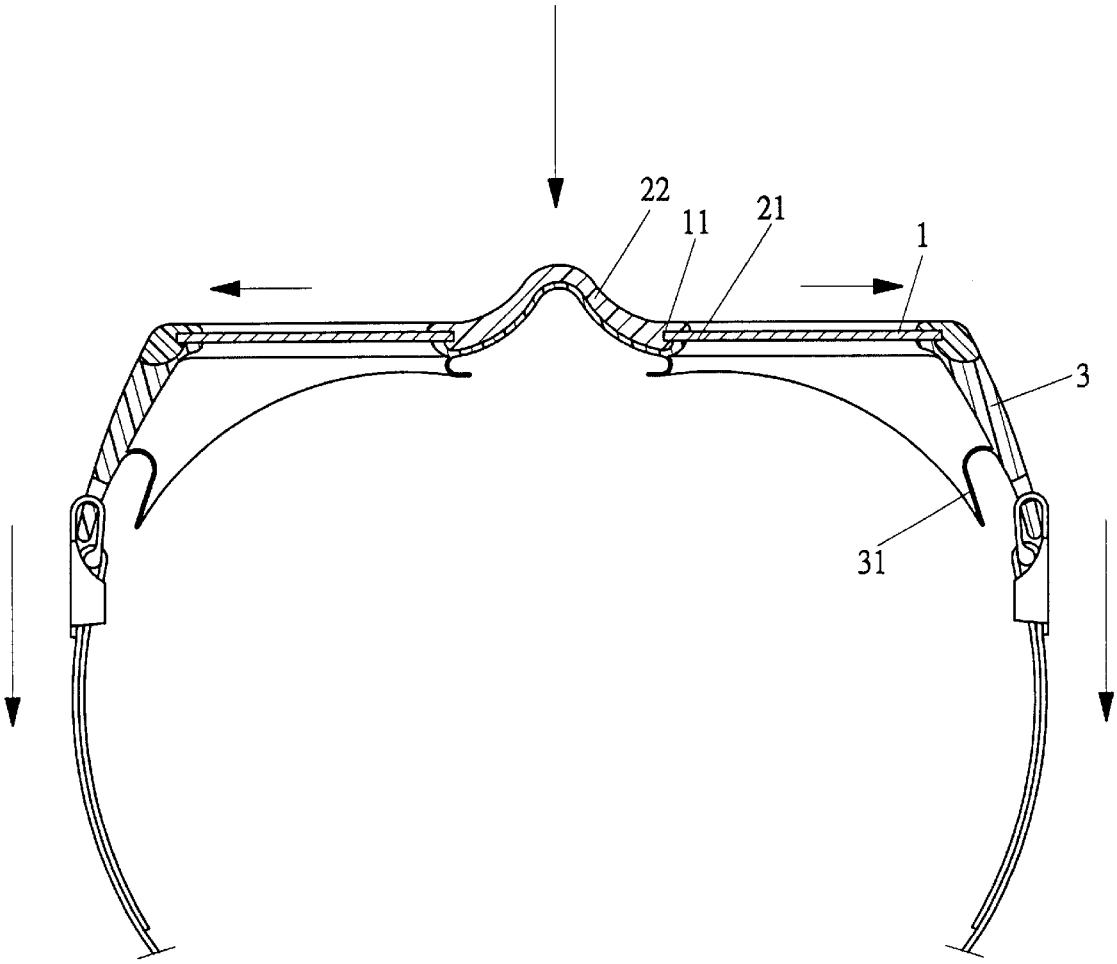
FIG. 4 is a top view, partly sectioned, of the pair of swimming/diving goggles in accordance with the present invention.

As illustrated in FIG. 4, the lenses 1 are enclosed by the protective frame 2 and thus have improved assembly reliability and waterproof effect. Since the protective frame 2 is more pull-resistant than the main frame 3, the protective frame 2 prevents disengagement of the peripheral edge 11 of the respective lens 1 from the protective frame 2. Thus, injury to the user's eye socket by the rigid sharp edge of the respective lens 1 is avoided.

The main frame 3 and the padding portions 31 made of soft material provide soft, comfort intimate contact with the user's eye sockets. Further, the bridge 22 of the protective frame 2 is formed by pull-resistant material and is thus less likely to deform. The bridge 22 thus does not press the user's nose even if a large force is applied to the head strap. The support reliability and wearing comfort are improved.

Figure 5:
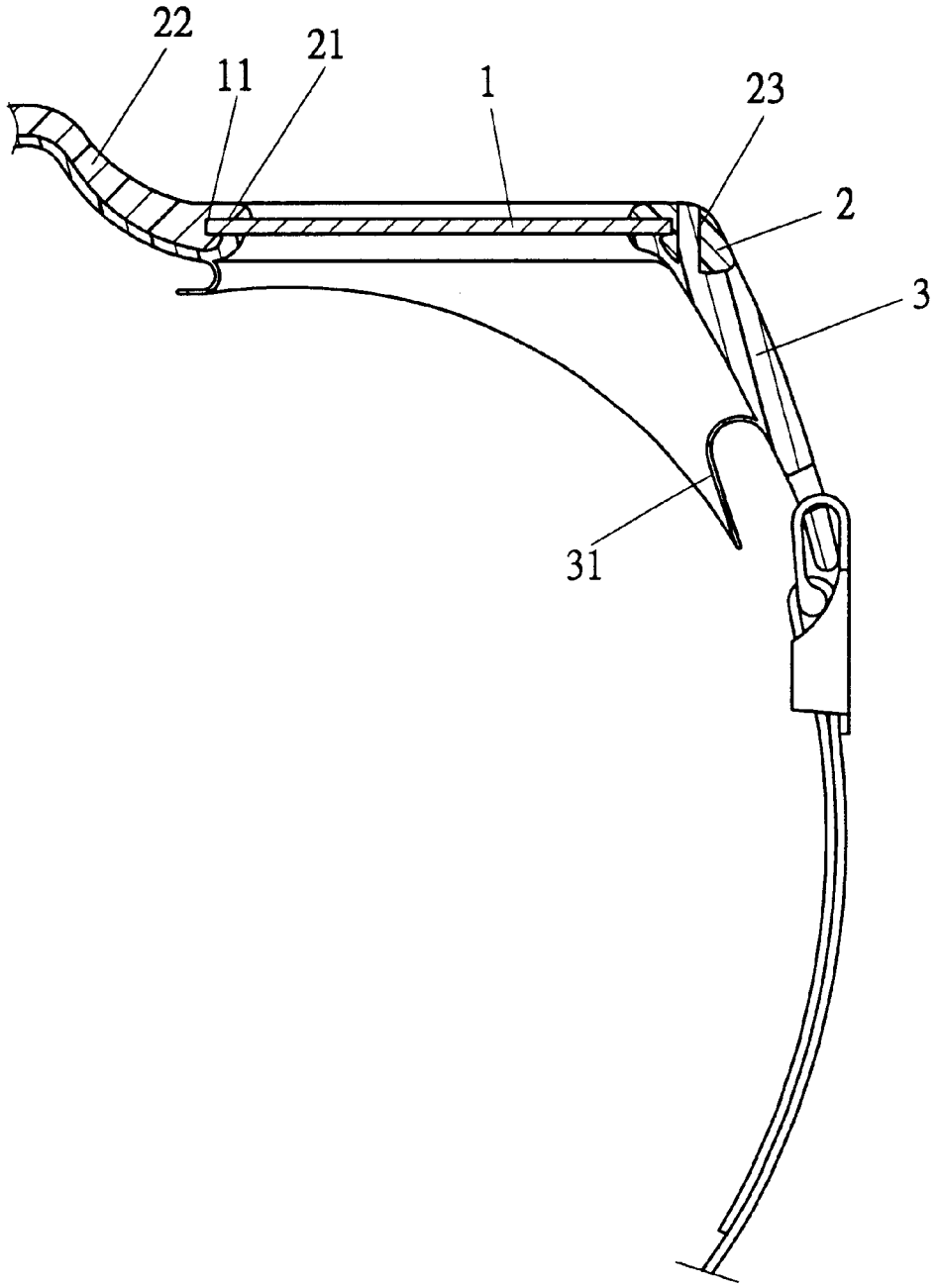
FIG. 5 is a view similar to FIG. 3, illustrating a modified embodiment of the pair of swimming/diving goggles in accordance with the present invention.
Figure 6:
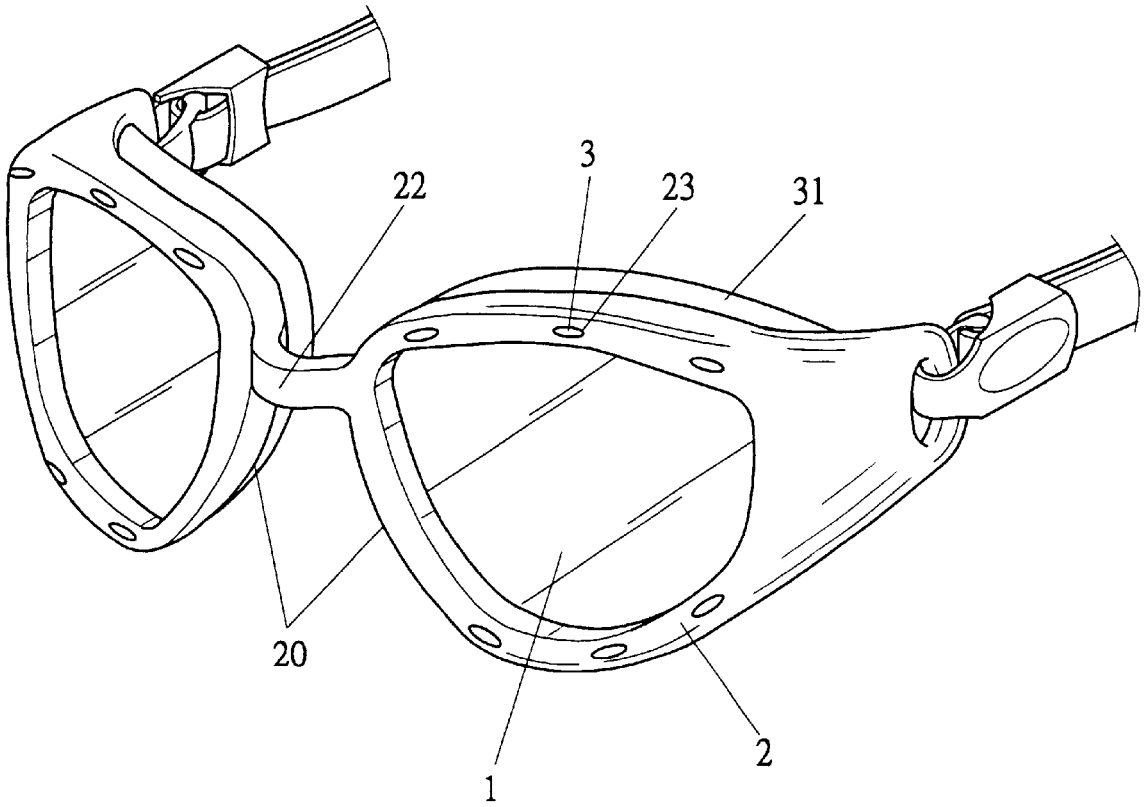
FIG. 6 is a perspective view of the modified embodiment in FIG. 5.

FIGS. 5 and 6 illustrate a modified embodiment of the invention, wherein each ring 20 of the protective frame 2 includes a plurality of through-holes 23. During formation of the main frame 3, the liquid material for the main frame 3 flows into the through-holes 23 of the protective frame 2. After hardening of the main frame 3, the assembly reliability and pull-resistance between the protective frame 2 and the main frame 3 are improved. In addition, the colors of the protective frame 2 and the main frame 3 can be selected to provide diversified ornamentation.

Figure 7:
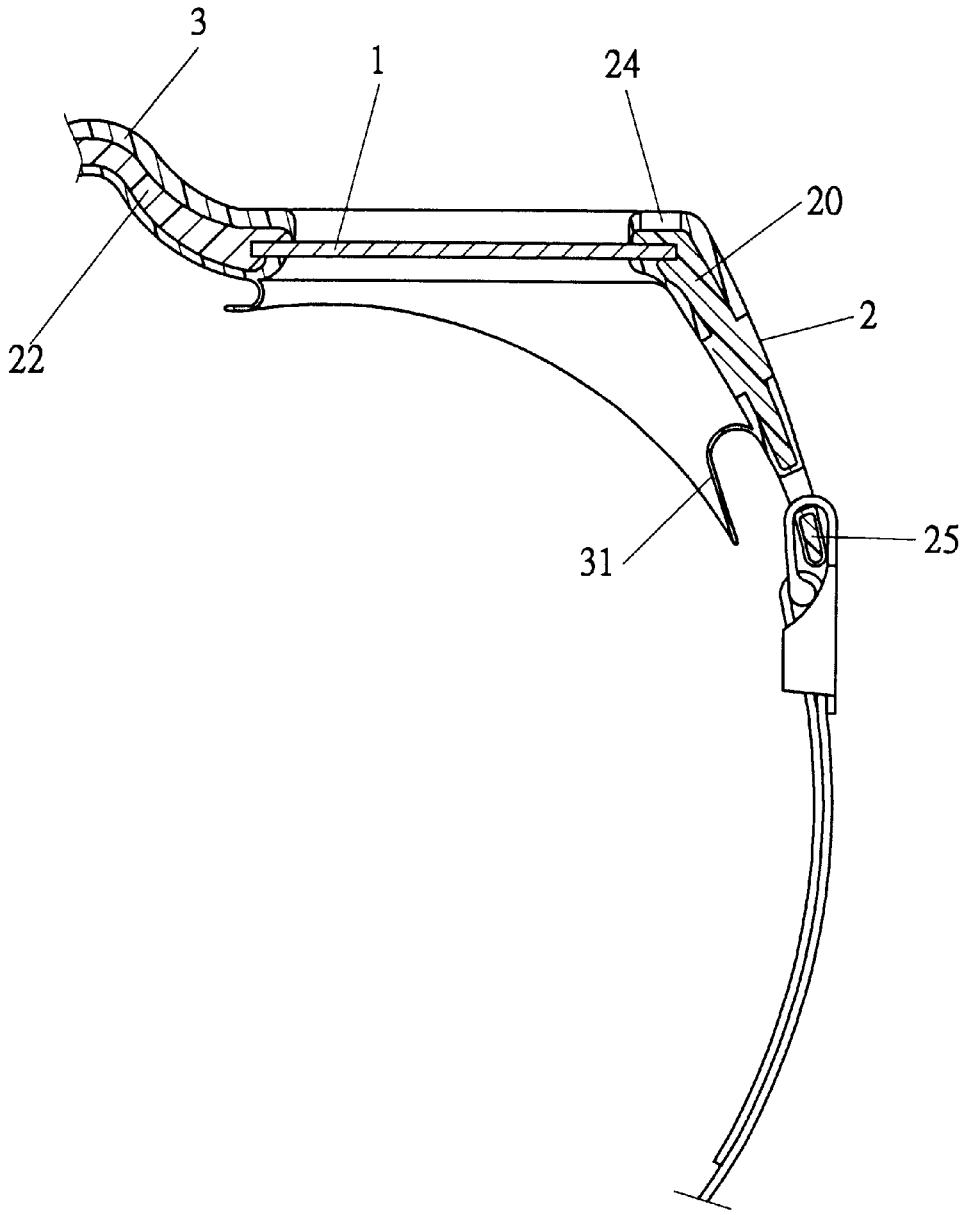
FIG. 7 is a view similar to FIG. 3, illustrating another modified embodiment of the pair of swimming/diving goggles in accordance with the present invention.
Figure 8:
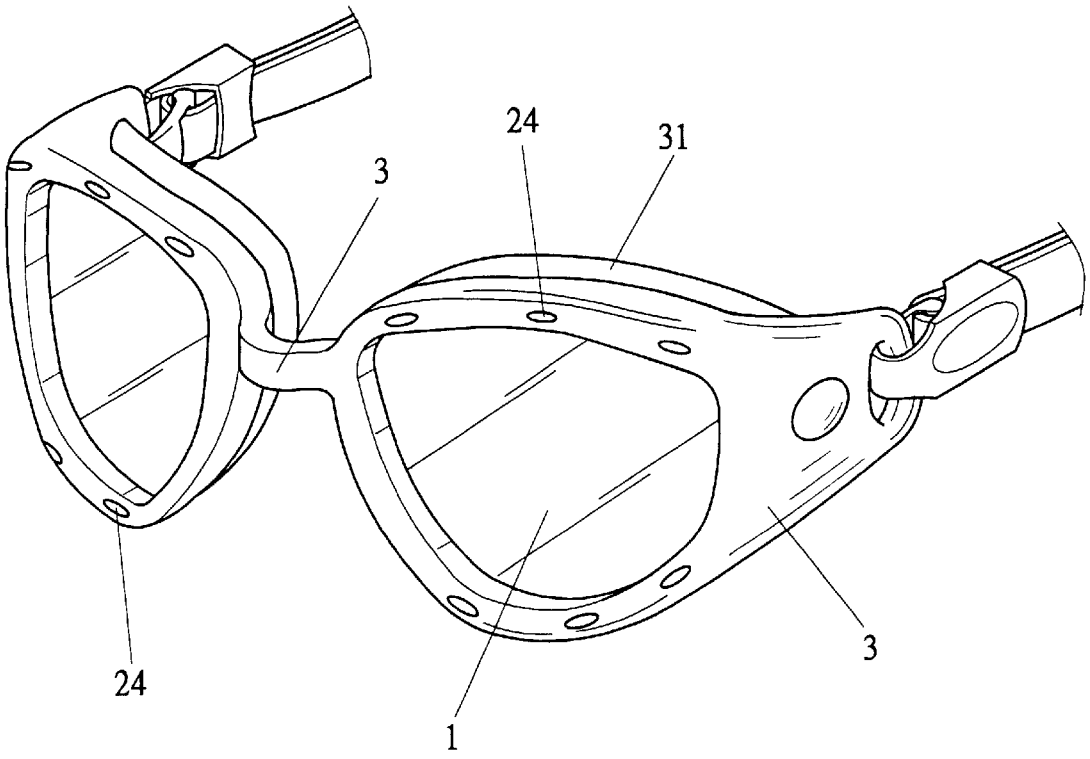
FIG. 8 is a perspective view of the modified embodiment in FIG. 7.
Figure 9:
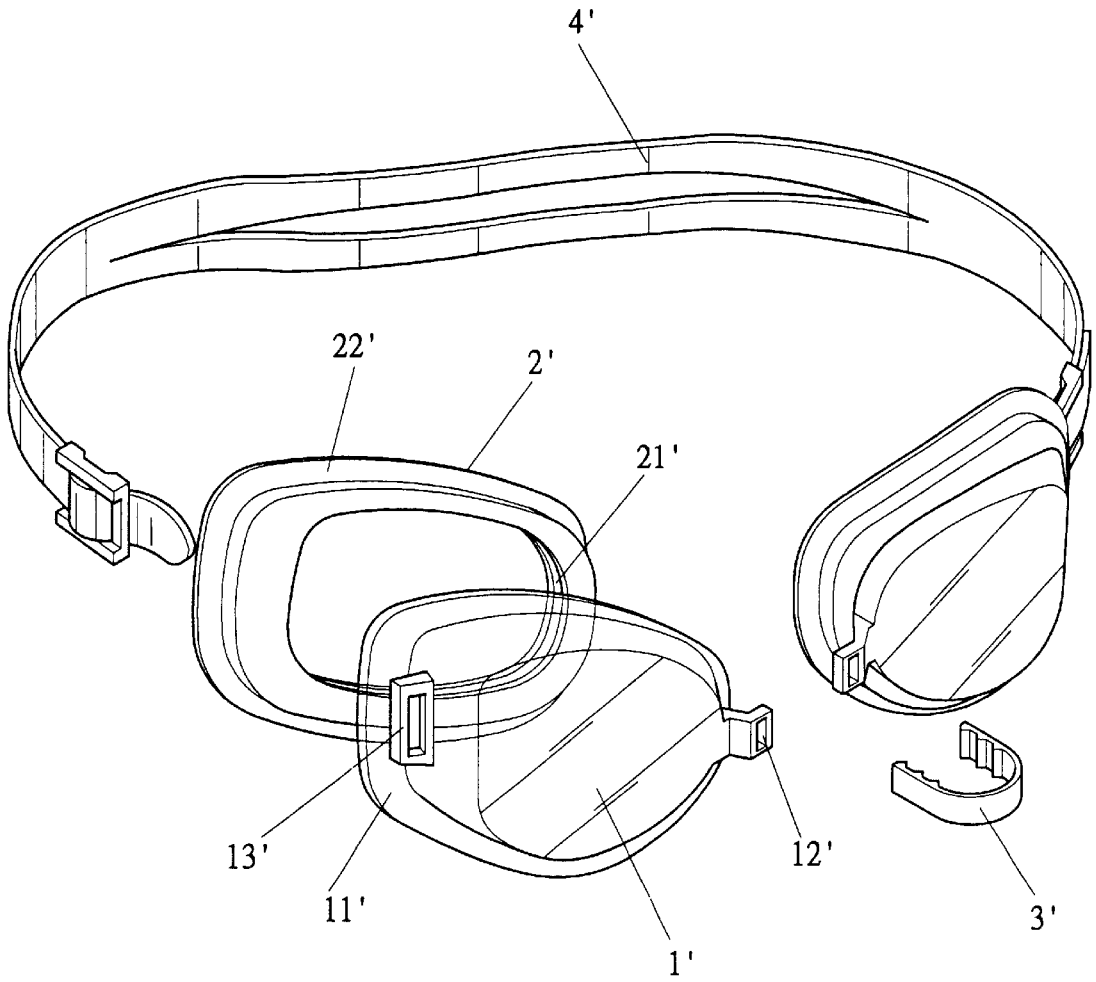
F I G . 9(PRIOR ART)
FIG. 9 is a perspective view, partly exploded, of a pair of conventional swimming goggles.
Figure 10:
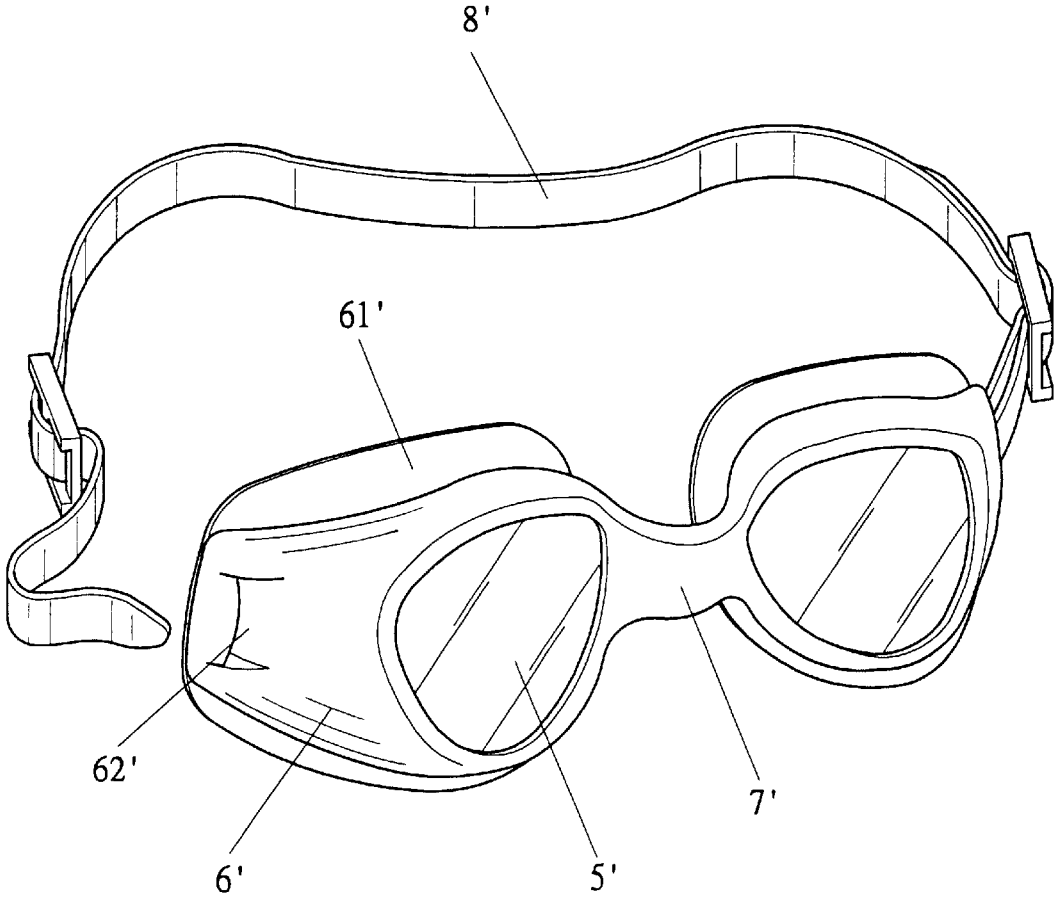
F I G . 10(PRIOR ART)
FIG. 10 is a perspective view of another pair of conventional swimming goggles.
Figure 11:
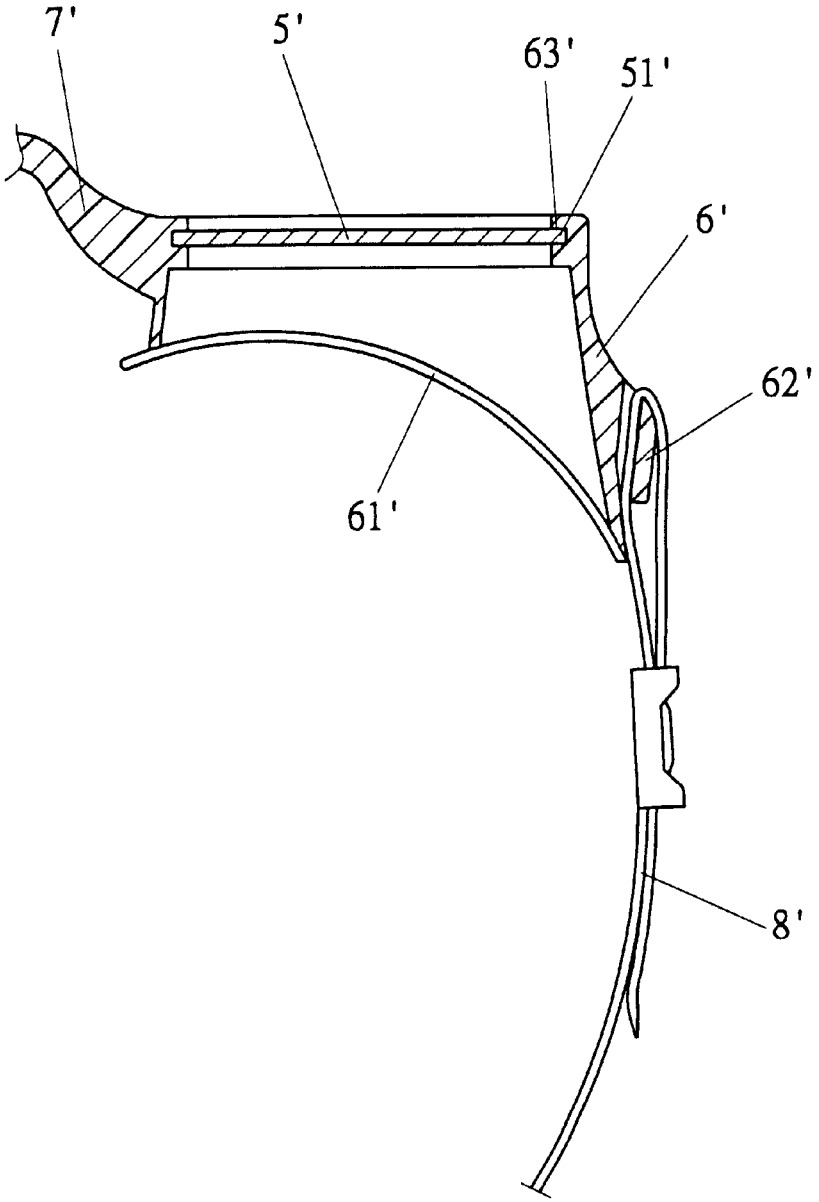
F I G . 11(PRIOR ART)
FIG. 11 is a top view, partly sectioned, of a portion of the pair of conventional swimming goggles in FIG. 10.
Figure 12:
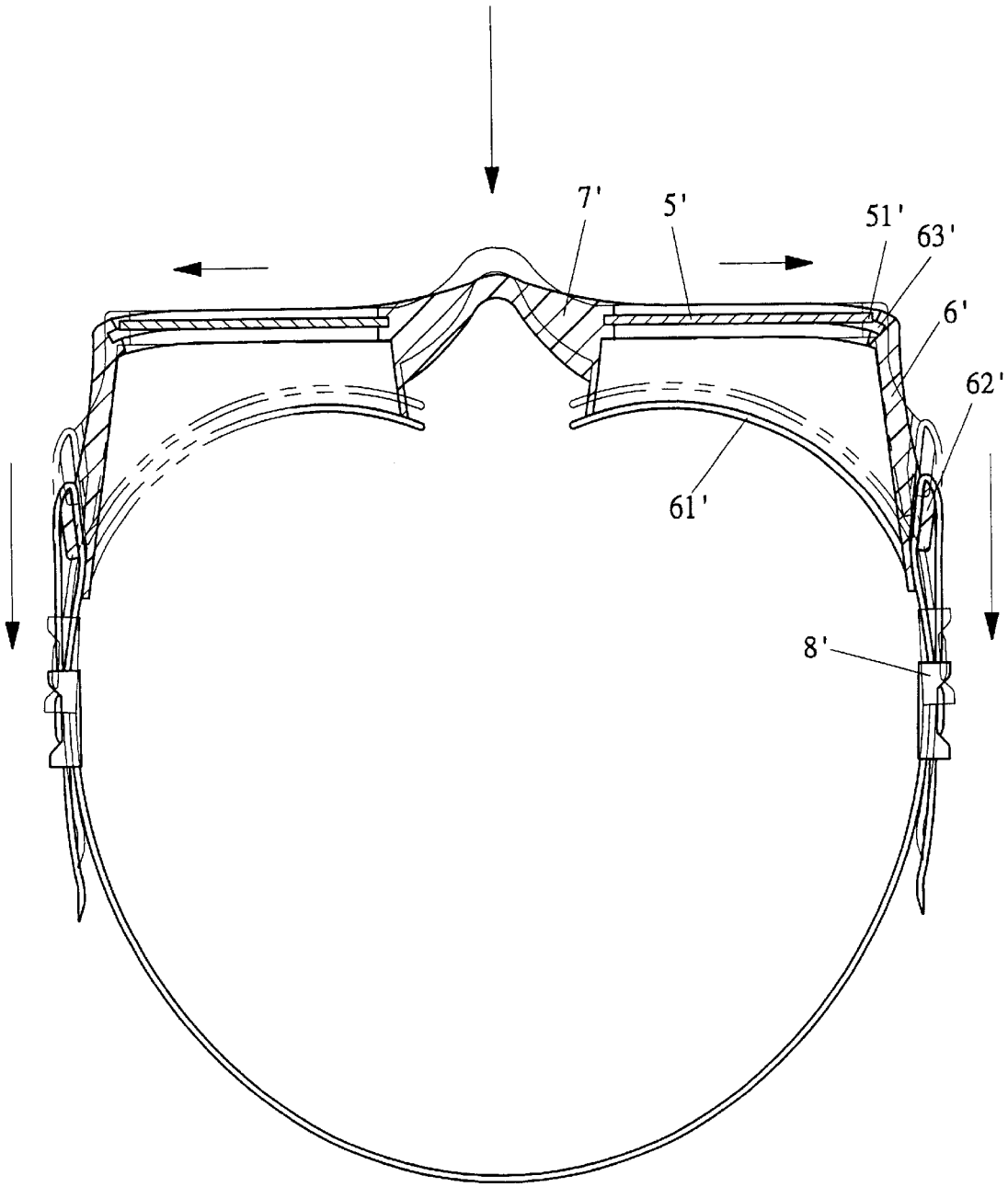
F I G . 12(PRIOR ART)
FIG. 12 is a top view, partly sectioned, of the pair of conventional swimming goggles in FIG. 10.

FIGS. 7 and 8 illustrate another modified embodiment of the invention, wherein each ring 20 of the protective frame 2 includes a plurality of protrusions 24, and the protective frame 2 includes two connecting portions 25 for connecting with two ends of the head strap. After hardening of the liquid material for the main frame 3, each protrusion 24 is embedded in the main frame 3 and includes an end face viewable from outside. When a pulling force is applied to the head strap, the protrusions 24 resist the pulling force and thus assure reliable engagement between the protective frame 2 and the main frame. In addition, the colors of the protective frame 2 and the main frame 3 can be selected to provide diversified ornamentation. The assembly reliability between the main frame 3 and the lenses 1 is improved by the connecting portions 25 of the protective frame 2.

According to the above descriptions, it is appreciated that the swimming/diving goggles in accordance with the present invention provides improved assembly reliability and waterproof effect. In addition, disengagement of the lenses during the wearing through pulling of the head strap is prevented. The padding portions 31 are made of soft material and the bridge 22 is made of pull-resistant material to provide wearing comfort and to prevent excessive deformation of the bridge 22. The through-holes 23 or the protrusions 24 improve the assembly reliability and pull-resistance between the protective frame 2 and the main frame 3. The colors of the protective frame 2 and the main frame 3 can be selected to provide diversified ornamentation. The assembly reliability between the main frame 2 and the lenses 1 is improved by the connecting portions 25 of the protective frame 2.

Although the invention has been explained in relation to its preferred embodiment, it is to be understood that many other possible modifications and variations can be made without departing from the scope of the invention as hereinafter claimed.

What is claimed is:

1. A pair of swimming/diving goggles comprising:

a) two lenses each made of rigid transparent material and including a peripheral edge;

b) a protective frame made of a material that is slightly flexible and pull-resistant, the protective frame including two rings each having a receiving groove for engaging with the peripheral edge of an associated one of the lenses; and c) a main frame made of soft material and securely engaged with the protective frame by means of molding injection, the main frame including two padding portions for intimate contact with a user's eye sockets, the protective frame preventing disengagement of the lenses from the protective frame and the main frame when a pulling force is applied for wearing the pair of swimming/diving goggles, wherein the protective frame includes a bridge for connecting the rings, wherein the bridge is made of a material that is pull-resistant.

2. The pair of swimming/diving goggles as claimed in claim 1, wherein the protective frame comprises a plurality of through-holes, and wherein liquid material for the main frame fills the through-holes of the protective frame during the molding injection, thereby providing assembly reliability between the protective frame and the main frame after hardening of the liquid material for the main frame.

3. The pair of swimming/diving goggles as claimed in claim 2, wherein the protective frame and the main frame are of different colors.

4. The pair of swimming/diving goggles as claimed in claim 1, wherein the protective frame includes a plurality of protrusions that is enclosed by a liquid material for the main frame, the protrusions providing a pull resistance to assure assembly reliability between the protective frame and the main frame after hardening of the liquid material for the main frame.

5. The pair of swimming/diving goggles as claimed in claim 4, wherein the protective frame and the main frame are of different colors.

6. The pair of swimming/diving goggles as claimed in claim 1, wherein the protective frame includes two connecting portions for respectively connecting with two ends of a head strap, the connecting portions providing a pull resistance to assure assembly reliability between the protective frame and the lenses.

7. A pair of swimming/diving goggles comprising:

a) two lenses each made of rigid transparent material and including a peripheral edge;

b) a protective frame made of a material that is slightly flexible and pull-resistant, the protective frame including two rings each having a receiving groove for engaging with the peripheral edge of an associated one of the lenses; and c) a main frame made of soft material and securely engaged with the protective frame by means of molding injection, the main frame including two padding portions for intimate contact with a user's eye sockets, the protective frame preventing disengagement of the lenses from the protective frame and the main frame when a pulling force is applied for wearing the pair of swimming/diving goggles, wherein the protective frame includes a bridge for connecting the rings, wherein the bridge is made of a material that is pull-resistant; wherein the protective frame comprises a plurality of through-holes, and wherein liquid material for the main frame fills the through-holes of the protective frame during the molding injection, thereby providing assembly reliability between the protective frame and the main frame after hardening of the liquid material for the main frame.

8. A pair of swimming/diving goggles comprising:

a) two lenses each made of rigid transparent material and including a peripheral edge;

b) a protective frame made of a material that is slightly flexible and pull-resistant, the protective frame including two rings each having a receiving groove for engaging with the peripheral edge of an associated one of the lenses; and c) a main frame made of soft material and securely engaged with the protective frame by means of molding injection, the main frame including two padding portions for intimate contact with a user's eye sockets, the protective frame preventing disengagement of the lenses from the protective frame and the main frame when a pulling force is applied for wearing the pair of swimming/diving goggles, wherein the protective frame includes a bridge for connecting the rings, wherein the bridge is made of a material that is pull-resistant; wherein the protective frame comprises a plurality of through-holes, and wherein liquid material for the main frame fills the through-holes of the protective frame during the molding injection, thereby providing assembly reliability between the protective frame and the main frame after hardening of the liquid material for the main frame; wherein the protective frame and the main frame are of different colors.

9. A pair of swimming/diving goggles comprising:

a) two lenses each made of rigid transparent material and including a peripheral edge;

b) a protective frame made of a material that is slightly flexible and pull-resistant, the protective frame including two rings each having a receiving groove for engaging with the peripheral edge of an associated one of the lenses; and c) a main frame made of soft material and securely engaged with the protective frame by means of molding injection, the main frame including two padding portions for intimate contact with a user's eye sockets, the protective frame preventing disengagement of the lenses from the protective frame and the main frame when a pulling force is applied for wearing the pair of swimming/diving goggles, wherein the protective frame includes a bridge for connecting the rings, wherein the bridge is made of a material that is pull-resistant, wherein the protective frame includes a plurality of protrusions that is enclosed by a liquid material for the main frame, the protrusions providing a pull resistance to assure assembly reliability between the protective frame and the main frame after hardening of the liquid material for the main frame.

10. A pair of swimming/diving goggles comprising:

a) two lenses each made of rigid transparent material and including a peripheral edge;

b) a protective frame made of a material that is slightly flexible and pull-resistant, the protective frame including two rings each having a receiving groove for engaging with the peripheral edge of an associated one of the lenses; and c) a main frame made of soft material and securely engaged with the protective frame by means of molding injection, the main frame including two padding portions for intimate contact with a user's eye sockets, the protective frame preventing disengagement of the lenses from the protective frame and the main frame when a pulling force is applied for wearing the pair of swimming/diving goggles, wherein the protective frame includes a bridge for connecting the rings, wherein the bridge is made of a material that is pull-resistant, wherein the protective frame includes a plurality of protrusions that is enclosed by a liquid material for the main frame, the protrusions providing a pull resistance to assure assembly reliability between the protective frame and the main frame after hardening of the liquid material for the main frame, wherein the protective frame and the main frame are of different colors.

* * * * *